US010589294B2

(12) United States Patent
Rusconi Clerici et al.

(10) Patent No.: US 10,589,294 B2
(45) Date of Patent: Mar. 17, 2020

(54) SEPARATOR FOR SEPARATING CHOPPED FOOD WASTE MATERIAL

(71) Applicant: ECOFAST ITALIA S.R.L.—TECNOLOGIE AMBIENTALI, Milan (IT)

(72) Inventors: Piero Rusconi Clerici, Milan (IT); Rinaldo Franceschini, Sarnico-Bergamo (IT)

( * ) Notice: Subject to any disclaimer, the term of this patent is extended or adjusted under 35 U.S.C. 154(b) by 76 days.

(21) Appl. No.: 15/552,291

(22) PCT Filed: Mar. 8, 2016

(86) PCT No.: PCT/EP2016/000415
§ 371 (c)(1),
(2) Date: Aug. 20, 2017

(87) PCT Pub. No.: WO2016/142059
PCT Pub. Date: Sep. 15, 2016

(65) Prior Publication Data

US 2018/0065129 A1 Mar. 8, 2018

(30) Foreign Application Priority Data

Mar. 10, 2015 (IT) ..... MI2015A0356

(51) Int. Cl.
*B04B 15/06* (2006.01)
*B04B 3/04* (2006.01)
(Continued)

(52) U.S. Cl.
CPC ..... *B04B 15/06* (2013.01); *B04B 3/04* (2013.01); *B04B 7/02* (2013.01); *B04B 11/02* (2013.01)

(58) Field of Classification Search
CPC ..... B04B 15/06; B04B 11/02; B04B 3/04; B04B 7/02
(Continued)

(56) References Cited

U.S. PATENT DOCUMENTS 1,011,078 A * 12/1911 Peck ..... B04B 1/14 494/11
2,499,457 A 3/1950 Buquoi
2,881,974 A * 4/1959 Ruf ..... B04B 1/00 494/42
(Continued)

FOREIGN PATENT DOCUMENTS

DE 287509 9/1915
FR 1005617 4/1952
(Continued)

*Primary Examiner* — Charles Cooley
(74) *Attorney, Agent, or Firm* — Themis Law

(57) ABSTRACT

A separator extracting dry chopped food waste material from wet chopped food waste material fed in fluid state includes an outer container for an internal centrifuge having a rotating cylinder with perforated walls, which contains a rotating screw that advances the wet chopped food material and separates the liquid portion therefrom; an inlet opening, which receives the wet chopped food material to be introduced into the rotating cylinder through a hollow duct inside the screw feeder, causing its upward movement and advancement; and an outlet opening, which evacuates the chopped material without the liquid portion. The outer container includes upper and lower half-shells that are monolithic and integral sanitation elements of the separator and a centering and sealing element at a coupling area, a flow-regulation valve being positioned at a lower opening to evacuate the separated liquid from the outer container.

9 Claims, 8 Drawing Sheets

(51) Int. Cl.
*B04B 7/02* (2006.01)
*B04B 11/02* (2006.01)

(58) Field of Classification Search
USPC ..... 494/27–30, 42, 83
See application file for complete search history.

(56) References Cited

U.S. PATENT DOCUMENTS 3,090,591 A * 5/1963 Clarkson ..... F16K 7/07 138/45
3,136,722 A * 6/1964 Gooch ..... B04B 3/02 210/212
3,348,767 A * 10/1967 Ferney ..... B04B 1/20 210/211
3,416,661 A * 12/1968 Ganiaris ..... B04B 3/04 210/178
3,416,662 A * 12/1968 Hedrick ..... B04B 3/04 210/215
3,416,663 A * 12/1968 Muller ..... B04B 3/04 210/215
3,437,209 A * 4/1969 Evans ..... B04B 1/20 210/374
3,438,501 A * 4/1969 Oyen ..... B04B 3/04 210/213
3,575,709 A * 4/1971 Ferney ..... B04B 3/04 127/19
3,802,621 A 4/1974 Merzenich
6,440,054 B1 * 8/2002 Galik ..... B01D 11/0461 494/22
2006/0175269 A1 * 8/2006 Shima ..... B04B 3/04 210/787
2006/0289348 A1 * 12/2006 Steinbeck ..... B04B 1/2016 210/224
2015/0136683 A1 * 5/2015 Rusconi Clerici ..... B02C 18/0092 210/368
2018/0065129 A1 * 3/2018 Rusconi Clerici ..... B04B 3/04

FOREIGN PATENT DOCUMENTS

GB 1125244 8/1968
WO WO-2016142059 A1 * 9/2016 ..... B04B 3/04

* cited by examiner

SEPARATOR FOR SEPARATING CHOPPED FOOD WASTE MATERIAL

FIELD OF THE INVENTION

The present invention relates to a separator suitable for separating dry chopped food waste material from wet chopped food waste material, fed in the fluid state.

BACKGROUND OF THE INVENTION

For some years now and even currently, various apparatuses have been used in the field of the chopping and dehydration of food waste, for the separation of the solid phase.

These apparatuses are positioned downstream of the group which effects the chopping of food waste and separate the finely dry chopped solid part from the wet chopped food waste fed in the fluid state.

In general, some more widely-used techniques can be found that can be divided into two main types.

A first type is that of so-called "press separators". These press separators comprise a screw-feeder or screw that is rotated inside a fixed cylinder with perforated walls, in turn positioned inside an outer container to receive and contain the squeezed and separated water.

Said screw feeder receives the wet chopped food waste material, fed in the fluid state by means of a lower opening formed inside said cylinder with perforated walls, and pushes it causing it to move and advance upwards.

A truncated-conical head is positioned in the upper part of the cylinder, which is held in position by means of a spring which creates an adequate pressure in the cylinder on the advancing food waste, selectively freeing a discharge opening.

In this way, the screw feeder, cooperating with the above-mentioned truncated-conical head, rotating inside the cylinder, squeezes the food waste, eliminating the liquid part, which is normally predominant, of said waste through the holes on the walls of the cylinder.

This liquid part therefore moves into the outer container mentioned above, which receives and holds the squeezed and separated water before sending it for discharge. In practice, the water is squeezed through the rotation of the screw feeder and, in order to facilitate its discharge and keep the outer container clean, washing nozzles are positioned and directed towards the outer surfaces of the walls of the perforated cylinder that remove solid residues that have exited with the squeezing.

The squeezed portion of food waste material, on the other hand, is pushed by the screw feeder rotating upwards, towards the discharge opening inside a specific collection container for the squeezed waste material, to be recovered, treated and adequately used.

A second known and used type is that of so-called "coaxial-centrifuge separators".

Also in this second type of separator, the two main elements, screw feeder and cylinder with perforated walls, are present but, in this case, they are both rotated.

It should be noted that the rotation rates of the two elements are generally slightly different and the cylinder with perforated walls usually rotates at a higher speed than the screw feeder.

In this second type of separating apparatus, the elimination of the liquid part squeezed from the wet food waste material in the fluid state contained therein, takes place by means of centrifugal force, again through the perforated walls of the cylinder which is also rotating, as mentioned above. Also in this case, the squeezed and centrifuged water is collected inside an outer container or carter, before being sent to the outside of the liquid separating apparatus.

An outer container receives and contains the squeezed and separated water and is equipped with washing nozzles, positioned in its interior, directed towards the outer surfaces of the walls of the perforated cylinder, to keep them clean. Consequently, inside the container there are nozzles and relative pipes which feed them with washing water.

At the same time, the squeezed part of the food waste material, pushed upwards by the rotating screw feeder, exits from a discharge opening and is collected in a specific container.

It should also be pointed out that both of these main known solutions have operative limitations mainly connected to cleaning the apparatus of the organic residues deriving from the squeezing which, in some way, are not eliminated from the screw feeder and penetrate the outer container to a certain extent. It is in fact important to avoid problems of hygiene and odors due to the residence of an easily perishable material such as waste food material which is deposited, even if in small quantities.

Centrifuge separators are at present the most advantageous solution from this point of view, as they are considered as being self-cleaning.

Press separators, on the other hand, require the daily dismantling of the screw for cleaning, which is obviously quite complicated and not a particularly pleasant activity.

As already mentioned, in both solutions, a series of nozzles are envisaged inside the container or containment carter, which produce water jets that vigorously hit the outer wall of the perforated cylinder removing the deposits of food remaining thereon.

This set of nozzles and pipes connecting them, however, represent an obstacle for the free flow of the filtered water towards the outside. Consequently, with time, they are sources of retention of residual organic material dispersed in the squeezed water.

Furthermore, it is immediately evident that inside the container or containment carter of the screw feeder/perforated cylinder group of centrifuge separators, there are areas in which the self-cleaning operation is difficult, residues remain deposited and this is also a significant limitation to the good hygiene of the whole apparatus.

SUMMARY OF THE INVENTION

The general objective of the present invention is to solve the drawbacks of the known art indicated above, in a very simple, economical and particularly functional manner.

A further objective of the present invention is to provide a separator of dry chopped food waste material from wet chopped food waste material, fed in the fluid state, which can be easily and completely cleaned.

Another objective of the present invention is to provide a separator of the type mentioned above, having a simple and compact construction, which does not need to be disassembled for its customary cleaning.

In view of the above objectives, according to the present invention, a separator of dry chopped food waste material from wet chopped food waste material, fed in the fluid state, has been conceived, having the characteristics indicated in the enclosed claims.

BRIEF DESCRIPTION OF THE DRAWINGS

The structural and functional characteristics of the present invention and its advantages with respect to the known art, will appear even more evident from the following description, referring to the enclosed drawings, which show an embodiment of a separator suitable for separating dry chopped food waste material from wet chopped food waste material, fed in the fluid state, produced according to the same invention.

In the drawings.

DETAILED DESCRIPTION OF EMBODIMENTS OF THE INVENTION

Figure 1:
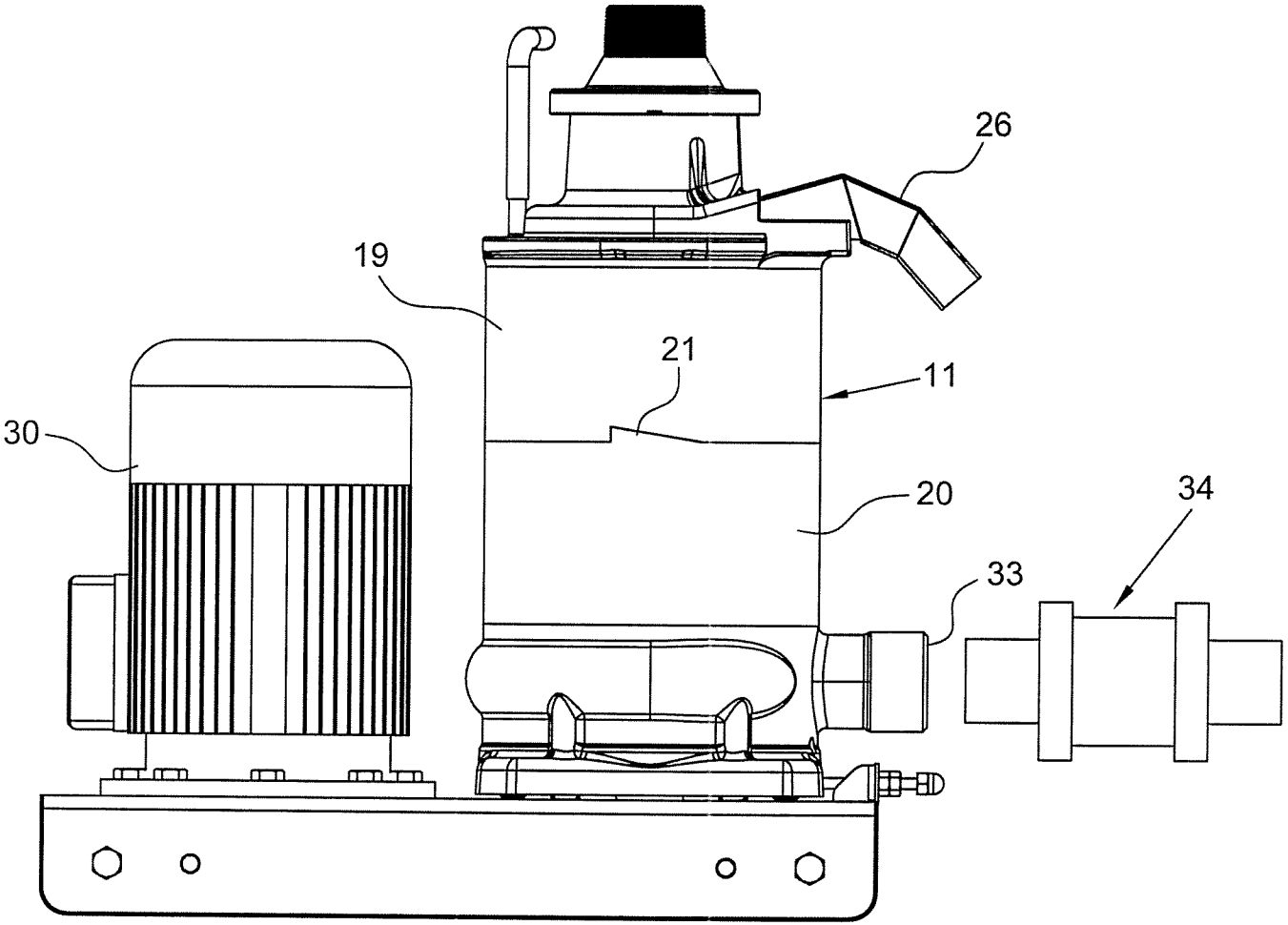
FIG. 1 is a raised side view of a separator suitable for separating dry chopped food waste material from wet chopped food waste material, fed in the fluid state, according to the present invention, wherein the discharge duct of the separated and dehydrated waste material is extracted.

With reference to the figures, these show a separator suitable for separating dry chopped food waste material from wet chopped food waste material, fed to the same in the fluid state, produced according to the present invention.

The separator comprises an outer container 11 for an internal centrifuge consisting of a rotating cylinder 12 with perforated side walls 13, in which a rotating screw feeder 14 is positioned for the advancement of the wet chopped food material and the separation of the liquid phase of the same.

An inlet opening 27 is positioned above, in an initial portion of a hollow duct 15 formed inside the axis of the screw feeder 14 and receives the wet chopped food material fed to the same in the fluid state. An opening 28 formed in a lower part of said hollow duct 15 allows the wet chopped food material to be fed in order to be treated inside the rotating cylinder 12. The screw feeder 14, rotating together with the cylinder, but at a different rate, causes the upward movement and advancement of said material to be treated.

Motorized pulleys 16, 17, situated in a lower position, are connected to the rotating cylinder 12 and to the screw feeder 14 respectively, causing their rotation, as they are driven by corresponding pulleys 16' and 17', fitted onto a shaft 29 of a driving motor 30.

The different number of teeth of the pulleys 16 and 17 allows them to have a different speed with respect to each other.

An outlet opening 18, situated at the top of the rotating cylinder 12 and of the outer container 11, evacuates the chopped material outwardly after removing the liquid portion.

The outer container 11 receives, by centrifugal action, the liquid portion separated from the chopped food material, moved forward by the screw feeder 14, which exits from the perforated walls 13 of the rotating cylinder 12.

According to the present invention, the outer container 11 consists of an upper half-shell 19 and a lower half-shell 20', equipped with centering and sealing means 21, produced, for example in the form of an interlocking step, positioned in correspondence with an intermediate coupling area. In particular, both of these half-shells 19 and 20 are monolithic in a structural material, preferably metal, such as anodized aluminum.

Furthermore, according to the invention, the side walls of the half-shells 19 and 20 have suitable holes 22 in which ends of spray nozzles 23 are positioned.

The ends of the spry nozzles 23 are contained flush with the side walls of the half-shells 19, 20.

This allows the nozzles and connection pipes that hinder the organic material dispersed in the liquid filtration part leaving the above centrifuge envisaged in known apparatuses, to be eliminated.

A collector 24 can be envisaged outside the outer container 11 for feeding the series of spray nozzles 23.

According to the provision of the present invention, it is envisaged that the two half-shells 19 and 20 be such as to integrate, in their two monolithic parts, the separate components of the known art, i.e. upper and lower heads, containment carter.

An outer container 11 is thus formed, consisting of the upper half-shell 19 and the lower half-shell 20 which is mechanically more solid and easy to assemble, capable of housing the constituent elements of the machine (bearings, hydraulic seals, flange connections and washing nozzles).

Figure 2:
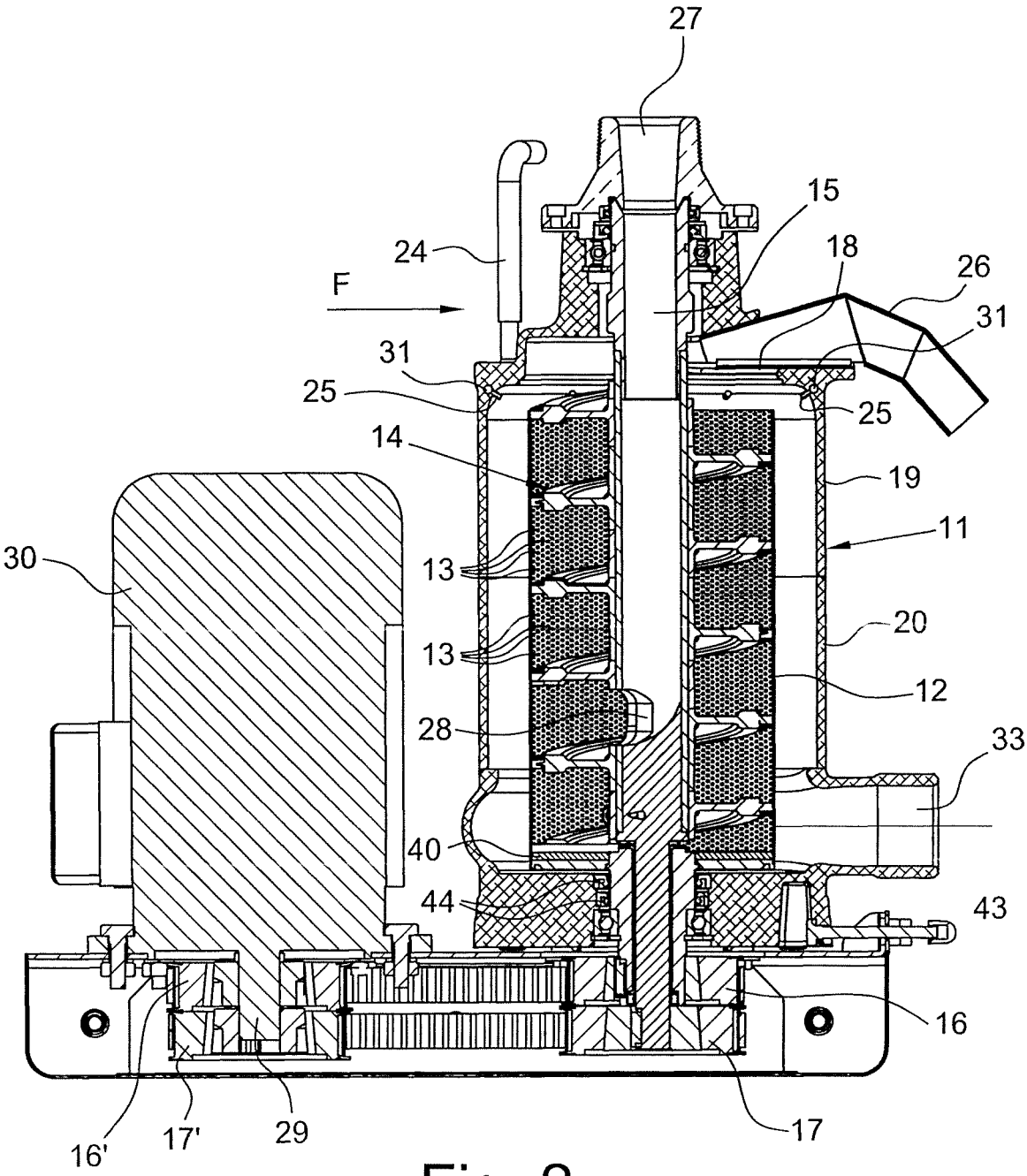
FIG. 2 is a schematic sectional view of the raised side view of FIG. 1 in an assembled arrangement.
Figure 3:
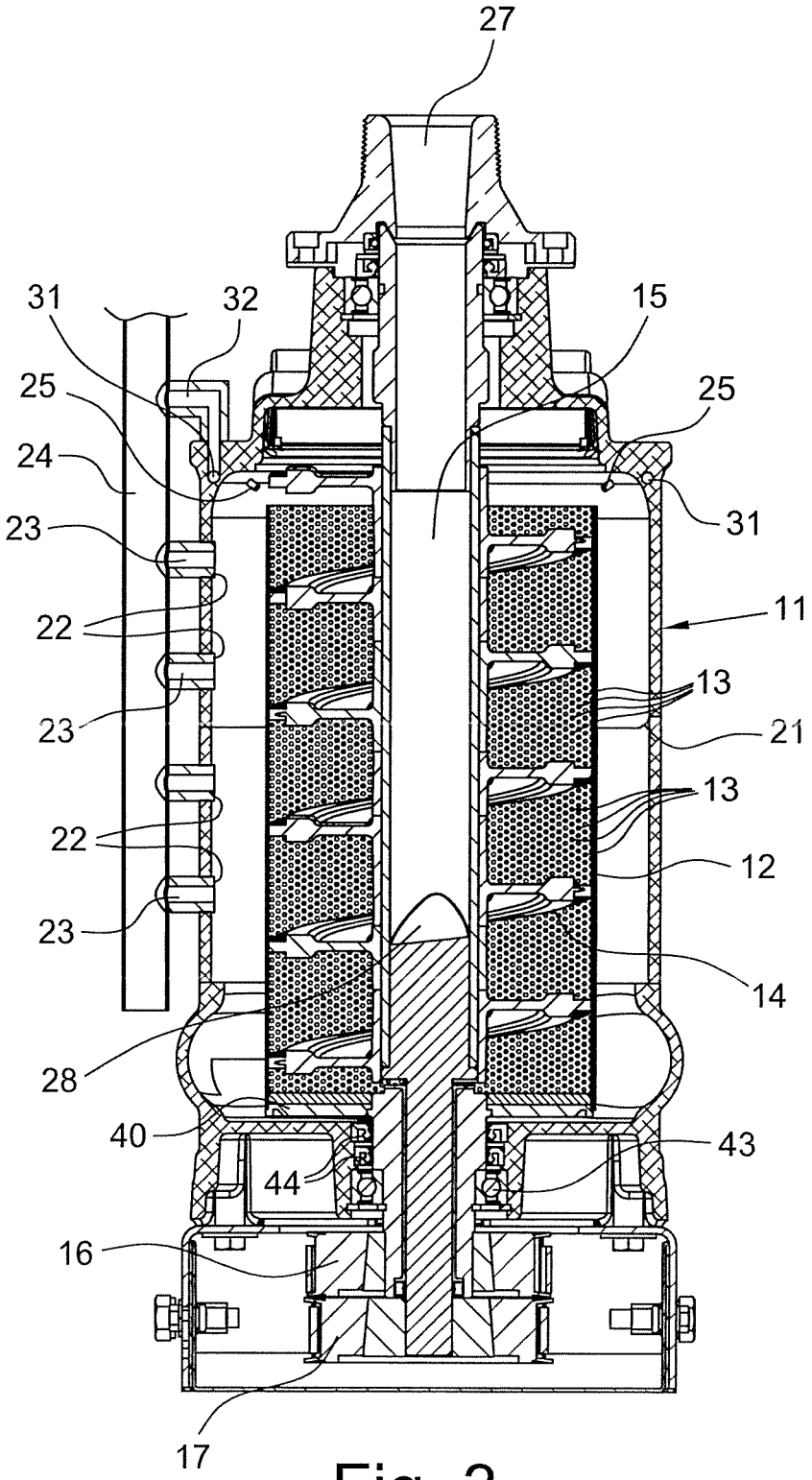
FIG. 3 is a sectional view rotated by 90.degree. with respect to that shown in FIG. 2, according to the arrow F.

Furthermore, in the embodiment of FIGS. 1-3, the invention also envisaged a further characteristic consisting of a cleaning system with water jets positioned in the upper part of the outer container 11.

Ducts 25 are in fact envisaged—in the upper end part of the upper half-shell 19, integrated inside the same body of the half-shell formed in the melting process of the half-shell—which are oriented connectable to a feeding of clean external water, also flush with the internal walls of the half-shell 19. Said feeding of water is effected by means of an internal channel 31 formed in the melting phase in the upper half-shell 19. Said channel 31 is in annular form and can also be connected by means of a pipe 32 connected to the collector 24.

In this way, the selective and/or combined feeding of the ducts 25 with the nozzles 23 allows waste slag to be eliminated in the apical area of the half-shell 29 which is deposited in an area not affected by the nozzles 23. Furthermore, as both the nozzles 23 and the ducts 25 are integrated in the half-shells 19, 20 of the outer container 11, they do not hinder or obstruct the discharging of the chopped waste material.

The nozzles 23 and the ducts 25 form sanitation elements integrated in the half-shells 19, 20 of the outer container 11.

Furthermore, according to a new particularly advantageous provision, a removable discharge duct 26 is situated in correspondence with the above-mentioned outlet opening 18 positioned at the top of the container 11, i.e. the upper half-shell 19.

In this way, said removable discharge duct 26 incorporates a portion of upper half-shell 19 and facilitates the cleaning of the component of the machine subject to the constant depositing of a certain quantity of chopped waste material which is thrown there by the rotating centrifugal dehydration force.

The new solution conceived therefore allows the problems of the known apparatuses to be completely eliminated.

Furthermore, in correspondence with a lower evacuation opening 33 of the liquid separated from the outer container 11, a flow-regulation valve 34 is envisaged (FIG. 1). The presence of this flow-regulation valve 34 allows a washing of the whole internal volume of the container 11 to be effected. Said washing is effected with an adequate quantity of detergent liquid, in particular clean water, withheld by the valve 34 inside the container 11 and set in vortical motion by the rotation of the centrifuge. It is evident that this mass of clean water in vortical motion is able to reach the whole internal volume of the container 11 removing any waste residues possibly present, allowing an effective cleaning of the apparatus.

Figure 4:
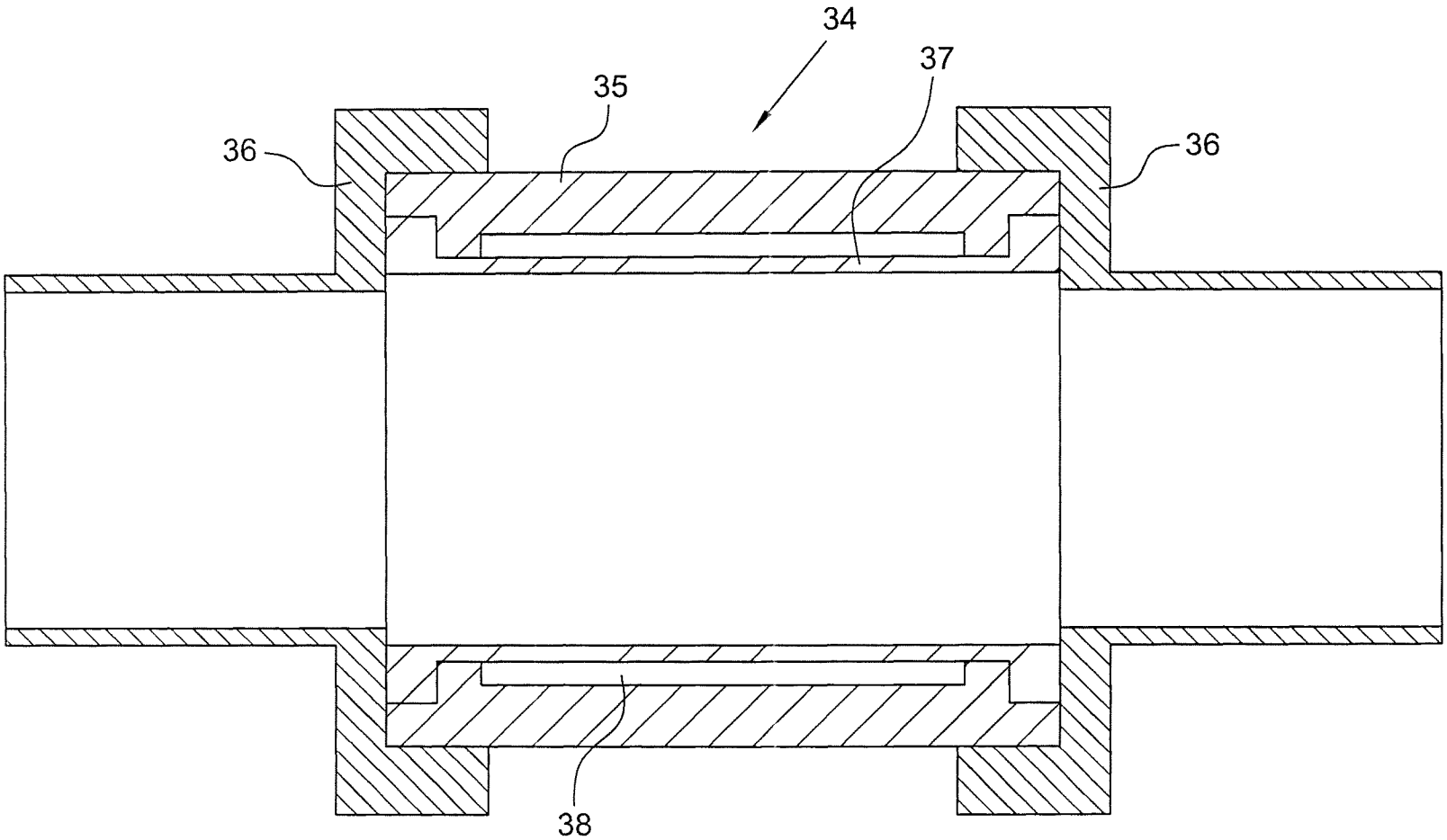
FIG. 4 is an enlarged sectional view of a flow-regulating valve positioned in correspondence with the lower discharge opening of the liquid from the separator.

In particular, as shown in FIG. 4, the flow-regulation valve 34 comprises, in an embodiment thereof, an outer rigid cylindrical body 35 and an internal flexible cylindrical body 37. The two bodies 35 and 37 are positioned between two hose connections with an end threaded ring 36. It should be noted that the internal flexible body 37 is positioned inside the outer rigid body 35, coaxial with respect to the outer rigid body 35, and made of an elastic material, for example NBR rubber subjected to deformation by pressure. A pressure chamber 38 is defined in an interspace between the outer rigid body 35 and the internal flexible body 37 in which a pressurized fluid is introduced, which generates a deformation of the internal cylindrical body 37 which is such as to hinder the flow of washing water leaving the lower opening 33. The pressure is generated, for example, by the water of an external hydraulic network, for example at 2.5-3 ATM.

Figure 5:
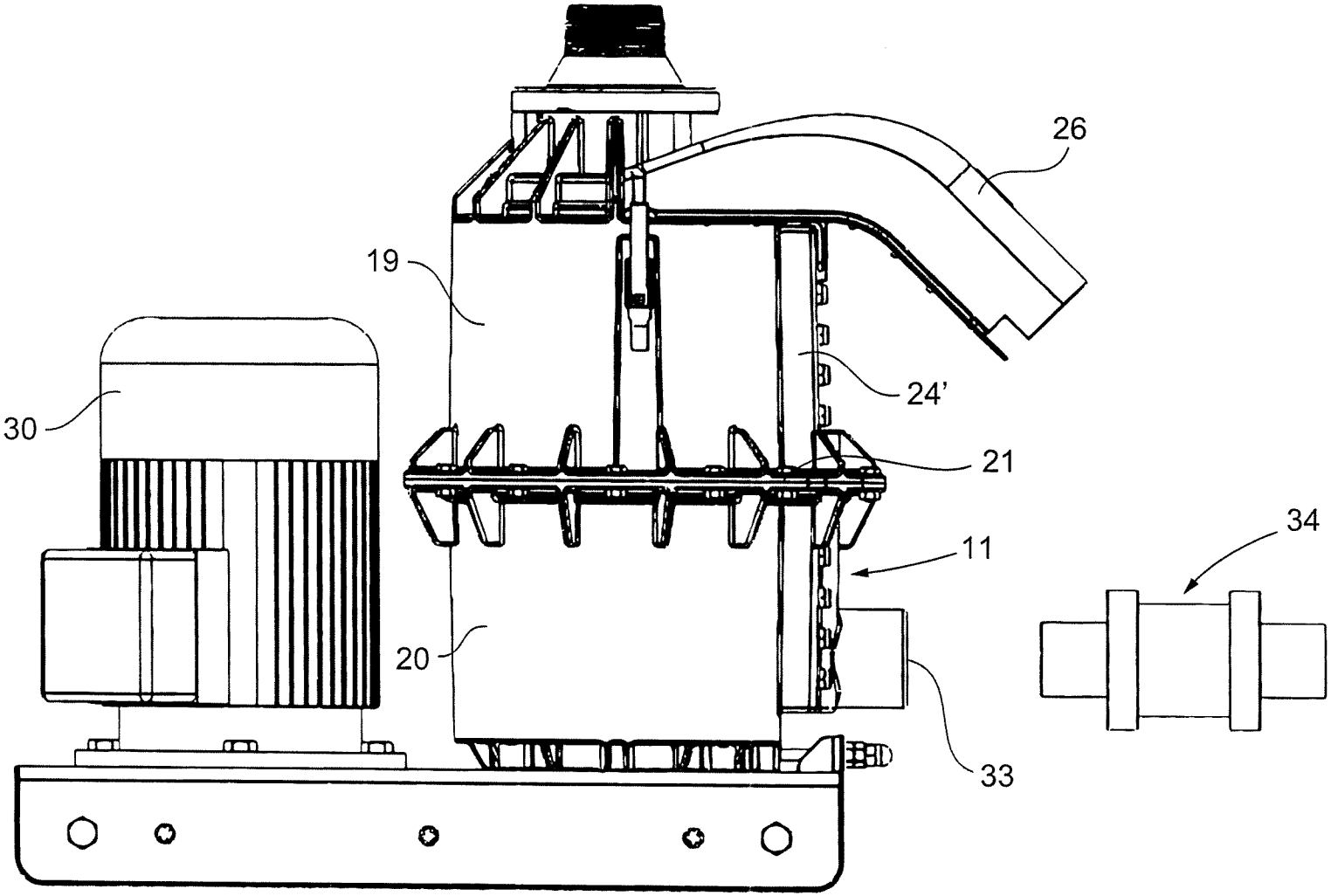
FIGS. 5, 6 and 7 are views equivalent to those of FIGS. 1, 2 and 3, of a further embodiment of a separator according to the present invention.
Figure 6:
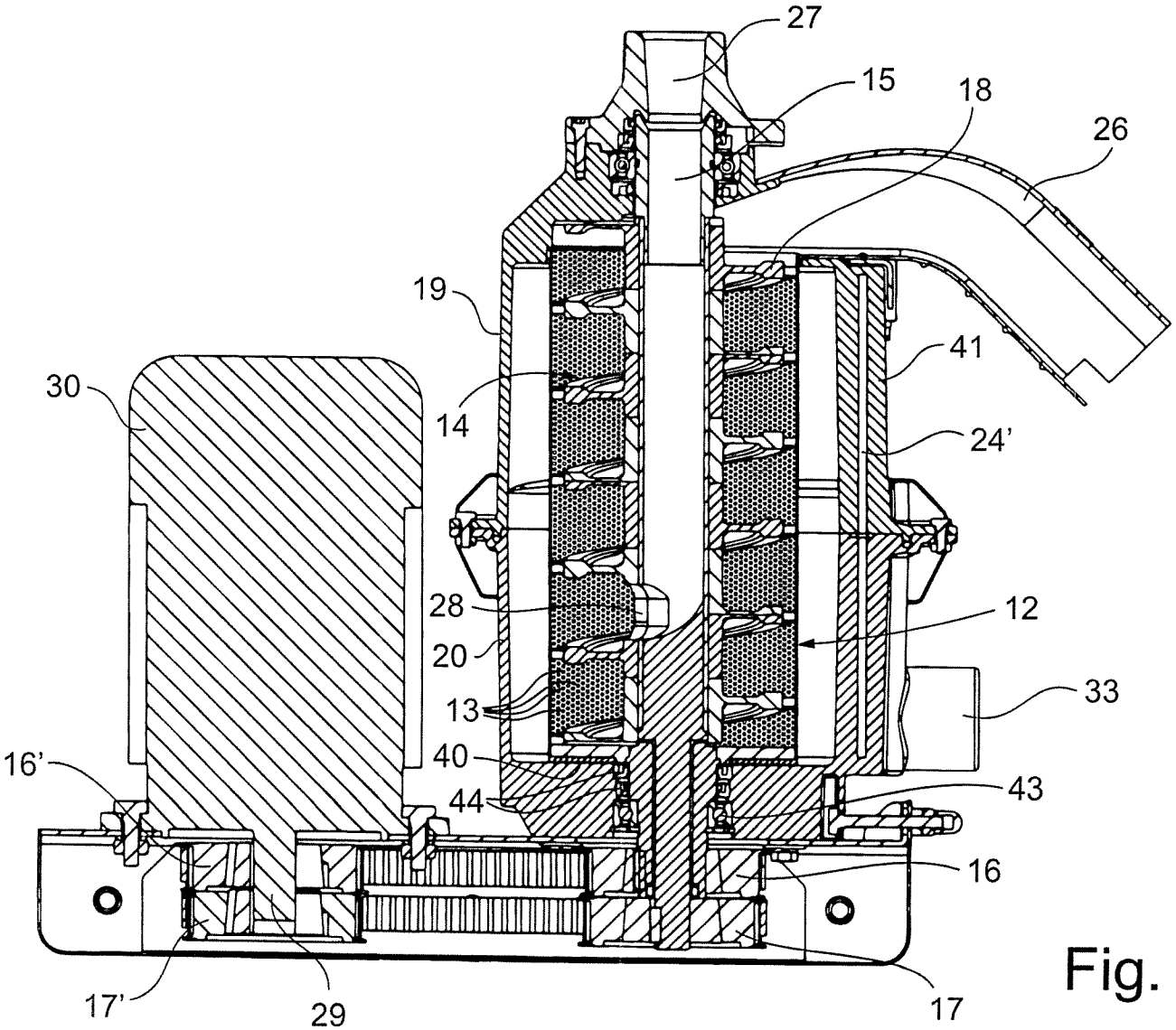
Figure 7:
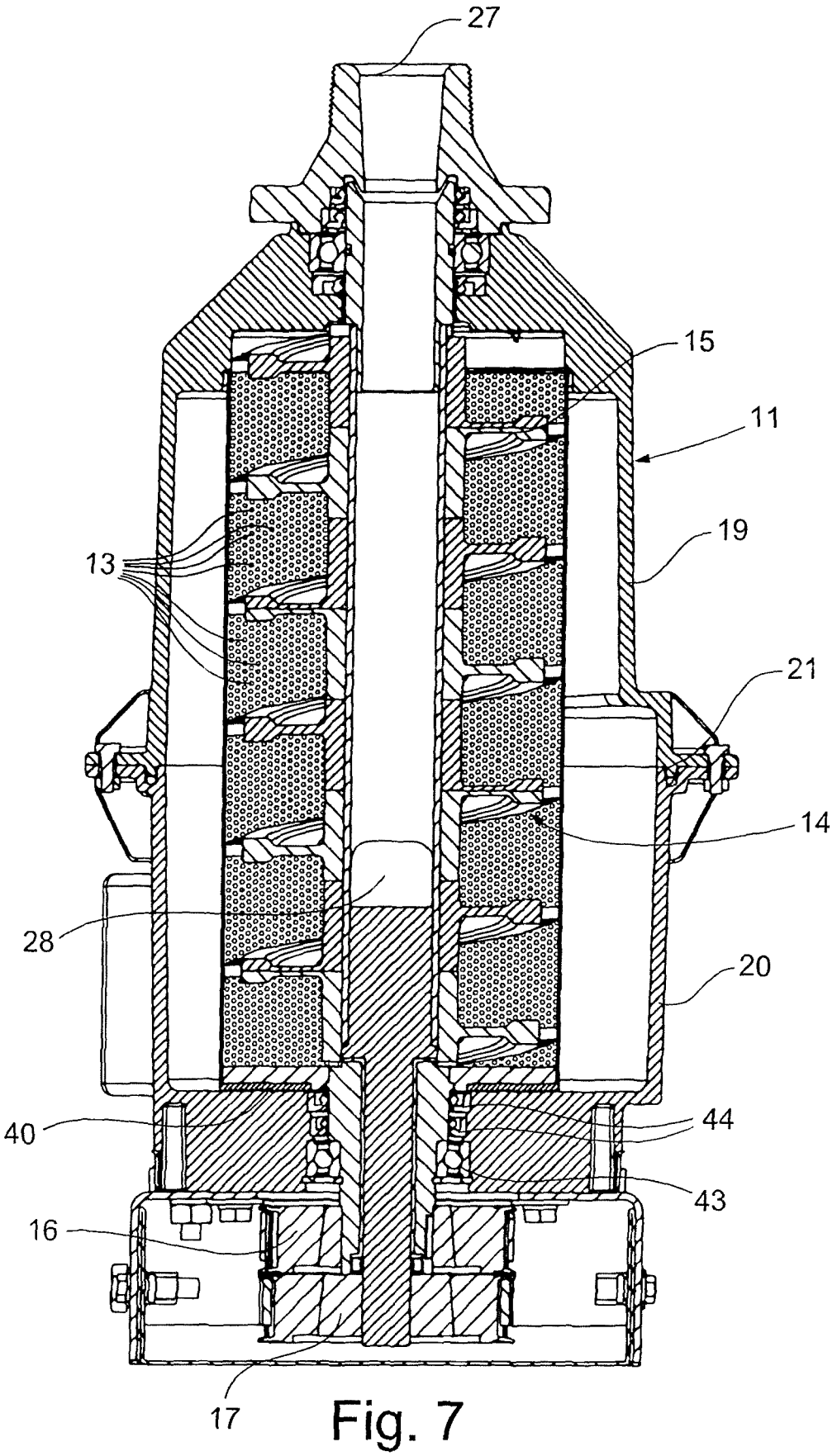

FIGS. 5-7 show a second embodiment of the separator of the invention in which similar elements are indicated with the same reference numbers.

Figure 8:
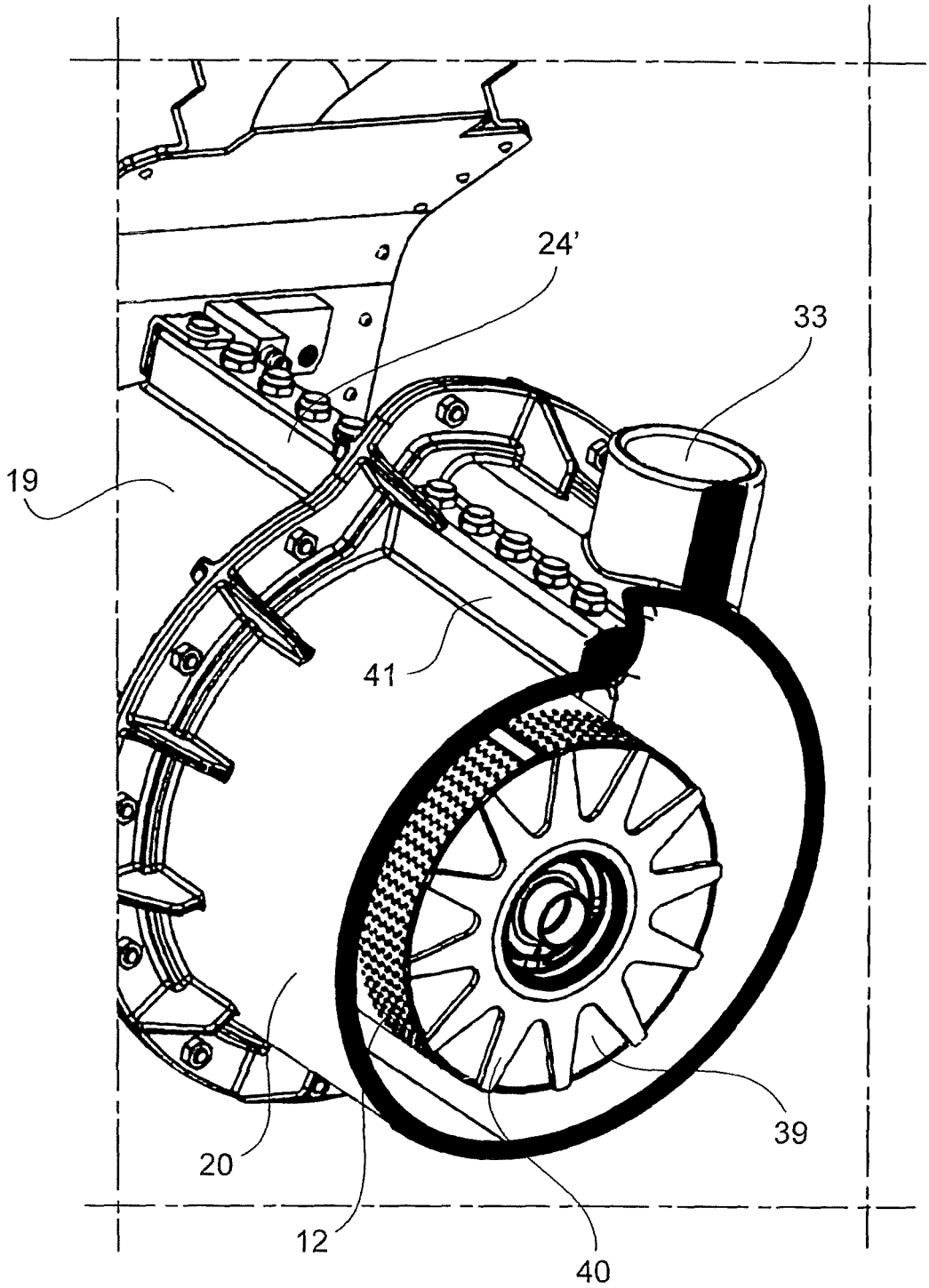
FIG. 8 is a perspective view of a part of the separator showing a lower wall of the rotating cylinder equipped with blades.

In this embodiment, it can be clearly seen in FIG. 8 how, below the rotating cylinder 12, a blade rotor 40 is advantageously and preferably envisaged on an outer wall 39 of the lower plate part. The presence of this blade rotor 40 also favors the cleaning and maintenance of the apparatus. Thanks to the centrifugal force impressed, the blades, in fact, prevent the dirty water generated during the dehydration operation to reach the housing area of a bearing 43. The dirty water, in fact, contains substances and particles that, with time, jeopardize the functioning of the same bearing in spite of the presence of sealing washers 44 which are not sufficient for guaranteeing a sufficient hydraulic sealing over a period of time. This provision of the blade rotor 40 is also envisaged in the embodiment of FIGS. 1 to 3.

In this embodiment of FIGS. 5 to 8, the outer container 11 is more compact and the spray nozzles 23 have been positioned directly at an end of a collector 24' incorporated in a side ribbing 41 of the outer container 11.

Also in this case, the ends of the spray nozzles 23 are contained flush with the side walls of the half-shells 19, 20.

In this way, the nozzles and connection pipes outside the separator are eliminated.

The separator of the present invention is thus produced.

It is important, in fact, to have first formed the outer body of the separator in two monolithic half-shells. It should again be repeated that this solution allows all the components previously and so far separated, such as the upper and lower head, and also the containment carter, to be integrated in two monolithic parts.

An outer body is thus formed, which is mechanically more solid and easy to assemble, capable of housing most of the constituent elements of the machine (bearings, hydraulic seals, flange connections).

The arrangement of the washing nozzles of the perforated cylinder is advantageously envisaged according to the invention on the side wall of the two half-shells.

FIGS. 1 and 2 show how a complete and rapid cleaning can be effected of the discharge duct 26 of chopped food material free of the liquid part, positioned in correspondence with the outlet opening 18 envisaged at the top of the container 11, i.e. the upper half-shell 19, thanks to its removability.

The removability of this duct 26 facilitates the cleaning of the component of the machine subject to the constant depositing of a certain quantity of chopped waste material during the functioning phase, deposited in the passage and also thrown there by the centrifugal dehydration force.

This applies to all the other advantages or elimination of previously-existing problems specified in the present description of the invention.

The objective mentioned in the preamble of the description has therefore been achieved.

The forms of the structure for producing a separator of the invention, as also the materials and assembly modes, can naturally differ from those shown for purely illustrative purposes in the drawings.

The protection scope of the invention is therefore defined by the enclosed claims.

The invention claimed is:

1. A separator separating dry chopped food waste material from wet chopped food waste material, fed in fluid state, comprising:

an outer container (11) for an internal centrifuge having a rotating cylinder (12) with perforated walls (13), an auger (14) being positioned within the rotating cylinder and causing an advancement of the wet chopped food material and separation of a liquid portion of the wet chopped food material;

an inlet opening (27) in the outer container (11), which receives the wet chopped food material to be introduced into said rotating cylinder (12) through a hollow duct (15) inside the auger (14), the auger causing an upward movement and advancement of the wet chopped food waste material within the rotating cylinder; and an outlet opening (18) positioned near a top of the rotating cylinder (12) and the outer container (11), the outlet opening outwardly evacuating the chopped food waste material from the rotating cylinder without the liquid portion, wherein said outer container (11) has an upper half-shell (19) and a lower half-shell (20) provided with a centering and sealing element (21) in correspondence with a coupling area, and wherein said half-shells (19,20) are monolithic and integral sanitation elements (23,25) of the separator;

further comprising:

a flow-regulation valve (34) positioned in correspondence with a lower opening (33) for evacuation of the separated liquid portion from the outer container (11), and a blade rotor (40) disposed below said rotating cylinder (12), on an outer wall (39) of a lower plate part of said rotating cylinder, said blade rotor comprising a plurality of blades arranged to prevent the liquid portion from reaching a housing of bearings of the rotating cylinder.

2. The separator according to claim 1, wherein said flow-regulation valve (34) comprises an outer rigid cylindrical body (35) and an inner flexible cylindrical body (37), wherein said outer rigid cylindrical body and said inner flexible cylindrical body (35,37) are positioned between two hose connections with an end threaded ring (36), and wherein said inner flexible body (37) is coaxial with the outer rigid body (35) and is subjected to deformation by pressure through a pressure fluid pumped into an interspace (38) between the outer rigid body (35) and the inner flexible body (37).

3. The separator according to claim 1, further comprising oriented ducts (25), disposed at least in an upper end part of the upper half-shell (19), integrated inside a body of the half-shell, the oriented ducts being connectable to a source of clean external water for elimination of waste slag inside said outer container (11) in an apical area of the half-shell (29).

4. The separator according to claim 3, wherein said oriented ducts (25) are connected to an annular channel (31) situated in said upper half-shell (19).

5. The separator according to claim 1, further comprising a removable discharge duct (26) situated in correspondence with said outlet opening (18) formed in the upper half-shell (19).

6. The separator according to claim 1, wherein said half-shells (19,20) are produced from a structural material.

7. The separator according to claim 1, wherein said half-shells (19,20) are monolithic and integral with components of the separator.

8. A separator separating dry chopped food waste material from wet chopped food waste material, fed in fluid state, comprising:

an outer container (11) for an internal centrifuge having a rotating cylinder (12) with perforated walls (13), a rotating auger (14) being positioned within the rotating cylinder and causing an advancement of the wet chopped food material and separation of a liquid portion of the wet chopped food material;

an inlet opening (27) in the outer container (11), which receives the wet chopped food material to be introduced into said rotating cylinder (12) through a hollow duct (15) inside the auger (14), the auger causing an upward movement and advancement of the wet chopped food waste material within the rotating cylinder; and an outlet opening (18) positioned near a top of the rotating cylinder (12) and the outer container (11), the outlet opening outwardly evacuating the chopped food waste material from the rotating cylinder without the liquid portion, wherein said outer container (11) has an upper half-shell (19) and a lower half-shell (20) provided with a centering and sealing element (21) in correspondence with a coupling area, and wherein said half-shells (19,20) are monolithic and integral sanitation elements (23,25) of the separator, and wherein side walls of said half-shells (19,20) contain holes (22), in which ends of spray nozzles (23) are positioned having ends that are contained flush with the side walls;

further comprising:

a flow-regulation valve (34) positioned in correspondence with a lower opening (33) for evacuation of the separated liquid portion from the outer container (11), and a blade rotor (40) disposed below said rotating cylinder (12), on an outer wall (39) of a lower plate part of said rotating cylinder, said blade rotor comprising a plurality of blades arranged to prevent the liquid portion from reaching a housing of bearings of the rotating cylinder.

9. A separator separating dry chopped food waste material from wet chopped food waste material, fed in fluid state, comprising:

an outer container (11) for an internal centrifuge having a rotating cylinder (12) with perforated walls (13), a rotating auger (14) being positioned within the rotating cylinder and causing an advancement of the wet chopped food material and separation of a liquid portion of the wet chopped food material;

an inlet opening (27) in the outer container (11), which receives the wet chopped food material to be introduced into said rotating cylinder (12) through a hollow duct (15) inside the auger (14), the auger causing an upward movement and advancement of the wet chopped food waste material within the rotating cylinder; and an outlet opening (18) positioned near a top of the rotating cylinder (12) and the outer container (11), the outlet opening outwardly evacuating the chopped food waste material from the rotating cylinder without the liquid portion, wherein said outer container (11) has an upper half-shell (19) and a lower half-shell (20) provided with a centering and sealing element (21) in correspondence with a coupling area, and wherein said half-shells (19,20) are monolithic and integral sanitation elements (23,25) of the separator, wherein side walls of said half-shells (19,20) contain holes (22), in which ends of spray nozzles (23) are positioned having ends that are contained flush with the side walls, and wherein said spray nozzles (23) are connected to a collector (24) positioned outside the outer container (11) for feeding the spray nozzles (23);

further comprising:

a flow-regulation valve (34) positioned in correspondence with a lower opening (33) for evacuation of the separated liquid portion from the outer container (11), and a blade rotor (40) disposed below said rotating cylinder (12), on an outer wall (39) of a lower plate part of said rotating cylinder, said blade rotor comprising a plurality of blades arranged to prevent the liquid portion from reaching a housing of bearings of the rotating cylinder.

* * * * *